US011970753B2

(12) United States Patent
Sonnleitner et al.

(10) Patent No.: US 11,970,753 B2
(45) Date of Patent: Apr. 30, 2024

(54) METHOD OF PRODUCING ULTRAHIGH-STRENGTH STEEL SHEETS AND STEEL SHEETS THEREFOR

(71) Applicant: voestalpine Stahl GmbH, Linz (AT)

(72) Inventors: Markus Sonnleitner, Hofkirchen (AT); Martin Klein, Linz (AT); Gerhard Hubmer, Marchtrenk (AT); Helmut Spindler, Oed-Ohling (AT)

(73) Assignee: voestalpine Stahl GmbH, Linz (AT)

( * ) Notice: Subject to any disclaimer, the term of this patent is extended or adjusted under 35 U.S.C. 154(b) by 580 days.

(21) Appl. No.: 17/276,280

(22) PCT Filed: Sep. 17, 2019

(86) PCT No.: PCT/EP2019/074815
§ 371 (c)(1),
(2) Date: Mar. 15, 2021

(87) PCT Pub. No.: WO2020/058244
PCT Pub. Date: Mar. 26, 2020

(65) Prior Publication Data

US 2021/0317544 A1 Oct. 14, 2021

(30) Foreign Application Priority Data

Sep. 18, 2018 (DE) ..... 10 2018 122 901.1

(51) Int. Cl.
*C21D 9/52* (2006.01)
*C21D 1/18* (2006.01)
(Continued)

(52) U.S. Cl.
CPC ..... *C21D 9/52* (2013.01); *C21D 1/18* (2013.01); *C21D 6/004* (2013.01); *C21D 6/005* (2013.01);
(Continued)

(58) Field of Classification Search
CPC ..... C21D 9/52; C21D 6/004; C21D 6/005; C21D 6/008; C21D 1/18; C21D 1/22;
(Continued)

(56) References Cited

U.S. PATENT DOCUMENTS 6,267,828 B1 7/2001 Kushida et al.
2010/0175452 A1 7/2010 Ohlert et al.
(Continued)

FOREIGN PATENT DOCUMENTS

CA 2284124 10/1998
DE 19710125 9/1998
(Continued)

OTHER PUBLICATIONS

International Search Report and Written Opinion for PCT/EP2019/074815.
(Continued)

*Primary Examiner* — Brian D Walck
*Assistant Examiner* — Danielle M. Carda
(74) *Attorney, Agent, or Firm* — Maxwell J Petersen; FisherBroyles, LLP

(57) ABSTRACT

A method for producing an ultra-high-strength hot-rolled structural steel includes producing a steel alloy with a carbon content not greater than 0.2%, avoiding a diffusive transformation of the austenite by achieving a transformation delay through the addition of manganese, chromium, and boron, and casting the steel alloy. The cast steel alloy is heated and hot rolled to form a steel strip which is then immediately hardened and mechanically straightened to produce mobile dislocations, wherein the boron, manganese and chromium delay diffusive transformation from an austenite structure to achieve formation of a martensite structure during the hardening. The steel strip is then annealed at a temperature between 100 and 200° C.

21 Claims, 6 Drawing Sheets

(51) Int. Cl.

| | |
|---|---|
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.
CPC ..... *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/06* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/008* (2013.01)

(58) Field of Classification Search
CPC .. C21D 8/0205; C21D 8/0226; C21D 8/0263; C21D 8/0242; C21D 2211/001; C21D 2211/008; C22C 38/001; C22C 38/002; C22C 38/02; C22C 38/06; C22C 38/44; C22C 38/46; C22C 38/48; C22C 38/50; C22C 38/54; C22C 38/58; C22C 38/04; C22C 38/26; C22C 38/28; C22C 38/32; C22C 38/38
USPC ..... 148/547
See application file for complete search history.

(56) References Cited

U.S. PATENT DOCUMENTS

| | | | | |
|---|---|---|---|---|
| 2015/0225822 | A1* | 8/2015 | Miura | C22C 38/005 148/333 |
| 2018/0044759 | A1 | 2/2018 | Schulz et al. | |
| 2018/0112286 | A1* | 4/2018 | Kim | C22C 38/28 |

FOREIGN PATENT DOCUMENTS

| | | |
|---|---|---|
| DE | 69924951 | 6/2000 |
| DE | 102014017275 | 5/2016 |
| EP | 025684881 | 12/1987 |
| EP | 3296416 | 3/2018 |
| JP | 2004300474 | 10/2004 |
| JP | 2015004081 A | 1/2015 |

OTHER PUBLICATIONS

German Office Action for DE 10 2018 122 901.1, dated May 6, 2019.

* cited by examiner

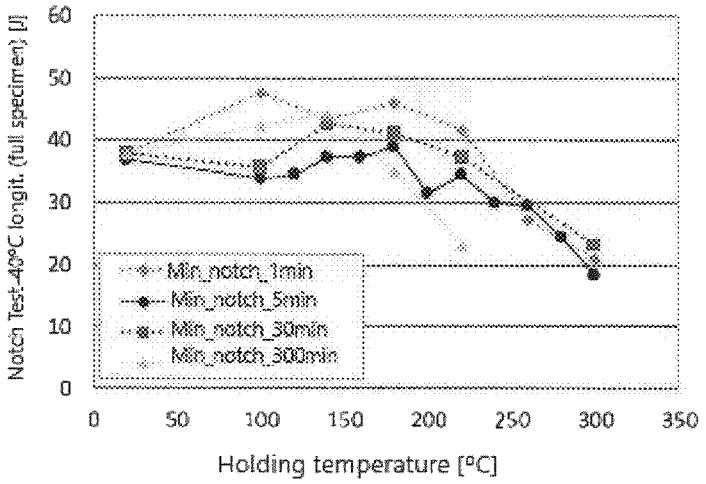
FIG 8
| Steel type | C | Si | Mn | P | S | Al | Cr | Ni | Mo | Cu | V | Nb | Ti | B | N |
|---|---|---|---|---|---|---|---|---|---|---|---|---|---|---|---|
| S1300 Ref 1 | 0.21 | 0.21 | 0.90 | 0.0067 | 0.0011 | 0.060 | 0.49 | 1.28 | 0.40 | 0.01 | 0.016 | 0.016 | 0.002 | 0.0012 | 0.0031 |
| S1300 Ref 2 | 0.21 | 0.23 | 0.89 | 0.0078 | 0.0006 | 0.063 | 0.52 | 1.29 | 0.38 | 0.01 | 0.022 | 0.018 | 0.005 | 0.0010 | 0.0035 |
| S1300 Ref 3 | 0.23 | 0.33 | 0.87 | | | 0.080 | 0.67 | 1.10 | 0.56 | | | 0.023 | | 0.0023 | |
FIG. 9
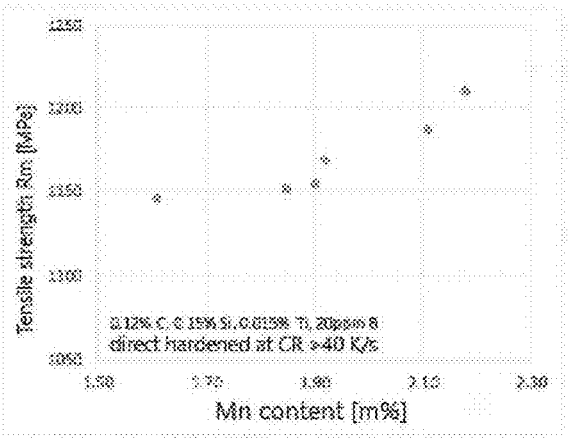
FIG. 10

From W. Schwenzfeier: Rolling Technology (Walzwerkstechnik) (Springer) 1979

From W. Schwenzfeier: Rolling Technology (Walzwerkstechnik) (Springer) 1979

METHOD OF PRODUCING ULTRAHIGH-STRENGTH STEEL SHEETS AND STEEL SHEETS THEREFOR

RELATED APPLICATIONS

This application is a 37 U.S.C. § 371 national stage application based on and claiming priority to International Application no. PCT/EP2019/074815, filed on 10 Sep. 2019, which in turn claims priority to German Patent Application DE 10 2018 122 901.1. filed on 18 Sep. 2018, the disclosures of which are incorporated herein by reference.

FIELD OF THE INVENTION

The invention relates to a method for producing ultra-high-strength hot-rolled steel sheets, a hot-rolled steel sheet, and a use of same.

BACKGROUND OF THE INVENTION

Hot-rolled structural steels and construction steels with minimum elastic limits above 960 MPa are not included in relevant standards (EN 10025, EN 10049). Structural steels and construction steels with such high elastic limits sold under various trade names are in fact currently available on the market, but they are expensive to produce. In order to achieve the required strengths, high alloy contents of carbon and/or other elements are needed. A high carbon content and in particular carbon contents above 0.22%, however, noticeably diminish the weldability of such steels. High contents of transformation-delaying elements such as molybdenum or nickel are expensive and resource-intensive, increase the scale-forming susceptibility, or result in high rolling forces.

Usually, steels of this kind are hot-rolled and hardened in a subsequent hardening step. Such a separate hardening process requires an energy-intensive reheating process. In addition, because of grain growth during reheating and the lack of grain-refining processes through recrystallization of the austenite structure, the achievable minimum austenite grain sizes are limited.

WO2017/016582 A1 has disclosed a high-strength steel material, which has a minimum elastic limit of 1300 MPa and a tensile strength of at least 1400 MPa. The carbon content in this case is between 0.23 and 0.25%.

WO2017/041862 A1 has disclosed a flat steel product, which is intended to have a combination of toughness and fatigue strength that is optimized for a use in the agricultural sector, the forestry sector, or comparable applications.

In this case, the 0.4 to 0.7% carbon content is quite high and high silicon and chromium contents are intended to reduce hydrogen permeability.

EP 22 67 177 B1 has disclosed a high-strength steel plate with 0.18 to 0.23% by mass carbon in which the weld crack sensitivity index PCM of the plate should be 0.36% by mass or less and the Ac3 transformation point should be less than or equal to 830° C. The microstructure should contain more than 90% martensite and the elastic limit should be greater than 1300 MPa; the tensile strength should be greater than 1400 MPa, but less than 1650 MPa. These sheets are clearly quarto sheets, which have been subjected to a classic hardening process.

WO2017/104995 A1 has disclosed a wear-resistant steel with a good toughness and hardnesses of 420 to 480 HB. In particular, the material has 0.15 to 0.2% carbon, 2 to 4% manganese, 0.02 to 0.5% silicon, and 0.2 to 0.7% chromium. Clearly, however, this material is hardened in the classic way.

EP 2576848 B1 has disclosed a direct-hardened hot-rolled strip with an elongated PAG, which is temper annealed at 200 to 700° C. The elastic limit in this case should be greater than 890 MPa and the carbon content is relatively low at 0.075 to 0.12%.

SUMMARY OF THE INVENTION

The object of the invention is to create a method for producing an ultra-high-strength hot-rolled structural steel, which permits a cost-effective, resource-efficient operation, ensures outstanding weldability, and is able to achieve sheet thicknesses of 2 mm and above.

The object is attained with a method having the following features:

A method for producing an ultra-high-strength hot-rolled structural steel or construction steel, wherein a steel is produced with a reduced carbon content that is not greater than 0.2%, wherein in order to avoid a diffusive transformation of the austenite, a sufficient transformation delay is achieved through the addition of manganese, chromium, and boron, wherein the steel material is cast in a known way and the cast material is subjected to a temperature increase for purposes of the hot-rolling, wherein the strip is direct hardened immediately after the rolling process, wherein the martensite structure forms from the deformed austenite, and the material that has been produced in this way is then mechanically straightened in order to produce mobile dislocations, wherein the material is then annealed in order to adjust the desired elastic limit or yield strength while at the same time preserving the tensile strength, toughness, and forming properties that are present after the direct hardening, wherein the annealing temperature is between 100 and 200° C., and wherein the steel includes the following alloying elements, all indications being expressed in percent by mass:

C=0.09 to 0.20
Si=0.10 to 0.50
P=max. 0.0150
S=max. 0.0050
Al=0.015 to 0.055
Ni=max. 0.5
Mo=max. 0.3
V=max. 0.12
Nb=max. 0.035
N=max. 0.0100
Ti=0.015 to 0.030
optional: Ca=0.0010 to 0.0040, wherein in order to avoid a diffuse transformation, boron in a content of 0.0008 to 0.0040 percent by mass is added to the alloy and in addition, chromium in contents of 0.2 to 1.0 percent by mass is added to the alloy in order to increase the hardenability and in addition, manganese in contents of 1 to 3 percent is added to the alloy along with residual iron and inevitable smelting-related impurities.

Advantageous modifications of the method are disclosed in the additional features described herein.

The object is also attained with a product having the following features.

A steel sheet, which is a hot-rolled steel sheet, wherein the steel sheet, a chemical composition, includes the following in percent by mass:

C=0.09 to 0.20
Si=0.10 to 0.50

Mn=1.0 to 3.0
P=max. 0.0150
S=max. 0.0050
Al=0.015 to 0.055
Cr=0.2 to 1.0
Ni=max. 0.5
Mo=max. 0.3
V=max. 0.12
Nb=max. 0.035
B=0.0008 to 0.0040
N=max. 0.0100
Ti=0.015 to 0.030
optional: Ca=0.0010 to 0.0040
Residual iron and inevitable smelting-related impurities.

Advantageous modifications of the product are disclosed in the additional features described herein.

In the invention, a steel material with adjusted alloying element contents is used, which after being melted and heated for hot-rolling purposes, is hot-rolled and direct hardened.

The hardened material produced in this way is then subjected to a straightening process followed by a special annealing treatment according to the invention.

According to the invention, it has been discovered that in order to increase the strength during annealing, a previously achieved plastic deformation is required so that a high dislocation density in the martensite is produced and a corresponding supply of forcibly dissolved carbon is stored in the structure.

According to the invention, annealing is performed in a temperature range of 120 to 200° for 1 to 30 minutes. It has thus been possible to surprisingly achieve the fact that the yield strength $R_p$ 02 increases without the tensile strength $R_m$ decreasing. If an upper limit for the annealing treatment of 200° C. is adhered to, then there is also no reduction in toughness. Below an annealing temperature of 100° C., there is no measurable effect on the elastic limit in technically relevant time frames and above 200° C., softening phenomena were observed. Preferably, annealing can be performed in a temperature range of 130° C. to 190° C. for 2 to 14 minutes and in particular 135° C. to 170° C. for 2 to 5 minutes; this makes it possible to achieve particularly advantageous combinations of Rp02 and Rm values.

BRIEF DESCRIPTION OF THE DRAWINGS

The invention will be explained by way of example based on the drawings. In the drawings:

FIG. 8: shows the influence of the annealing temperature and time on the notched bar impact bending work;

FIG. 9: shows the chemical composition of three reference examples not according to the invention, FIG. 10: shows the dependence of the tensile strength Rm in MPa on the manganese content;

DETAILED DESCRIPTION OF THE INVENTION

Figure 1:
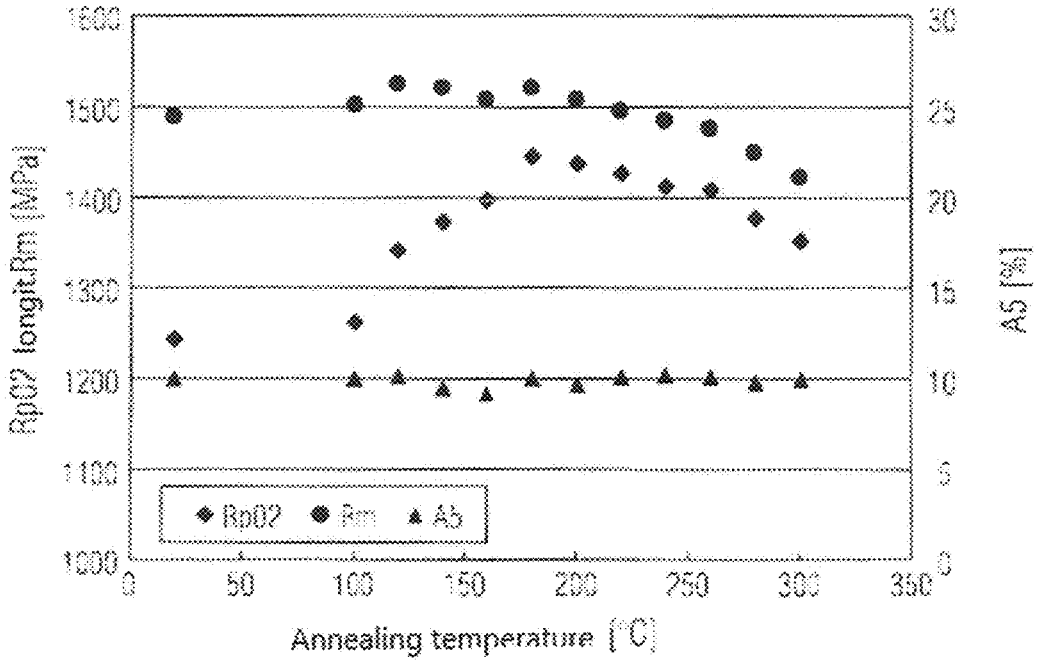
FIG. 1: shows the influence of the annealing temperature on mechanical grain values.

FIG. 1 shows the influence of the annealing temperature on the yield strength Rp02, die tensile strength Rm, and the elongation at break A5 (holding time: 5 minutes). The initial state is a direct-hardened, straightened material.

Figure 2:
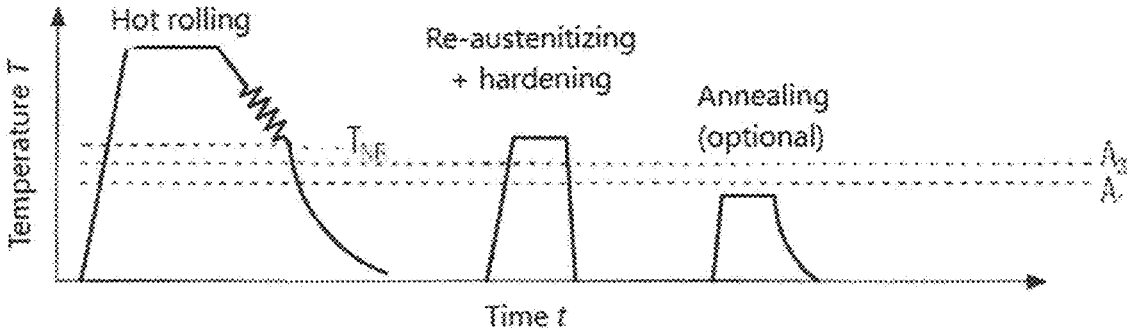
FIG. 2: schematically depicts the processing sequence in the prior art.

FIG. 2 schematically depicts the processing sequence in the production of hardened and tempered sheets according to the prior art. After the hot rolling, the rolling stock cools relatively slowly so that a martensitic transformation of the austenite does not occur or only occurs to a slight degree. In the subsequent hardening process, the material is austenitized and quenched at a cooling rate that is high enough to obtain a martensitic structure. Optionally, an annealing step at 500-650° C. can then be carried out in order to adjust the desired mechanical properties.

With regard to the chemical composition, in particular a steel with the following composition is used (all indications are expressed in m %):

C=0.09 to 0.20
Si=0.10 to 0.50
Mn=1.0 to 3.0
P=max. 0.0150
S=max. 0.0050
Al=0.015 to 0.055
Cr=0.2 to 1.0
Ni=max. 0.5
Mo=max. 0.3
V=max. 0.12
Nb=max. 0.035
B=0.0008 to 0.0040
N=max. 0.0100
Ti=0.015 to 0.030
optional: Ca=0.0010 to 0.0040
Residual iron and inevitable smelting-related impurities.

In this case, carbon is decisively responsible for the material strength in the direct-hardened state; contents of greater than 0.2% should be avoided for the sake of the weldability.

A sufficient transformation delay, i.e. the avoidance of a diffusive transformation of the austenite is required in order to achieve a martensitic structure. In the present case, this is achieved by means of the elements manganese, chromium, and boron.

There is no need for more expensive elements like nickel or molybdenum. The formation of boron nitrides would lead to an impermissible reduction in the dissolved boron content. To avoid this, titanium is added in order to bond to the free nitrogen.

Reference materials from the prior art are shown in FIG. 9 and in the table below. It has turned out that the strength level that is desired in the present case (1300 MPa) necessitates carbon contents of greater than 0.2%. In addition, the content of transformation-delaying elements is high, was can naturally have a negative effect on the production costs, minimum achievable thickness, and surface quality. According to the invention, however, it is in particular possible to do without elements that increase the production costs. These are also usually the elements that influence the minimum achievable thickness; here, too, the desired conditions can be easily achieved with the alloying state according to the invention.

Prior Art Compositions

| Steel type | C | Si | Mn | P | S | Al | Cr | Ni | Mo | Cu | V | Nb | Ti | B | N |
|---|---|---|---|---|---|---|---|---|---|---|---|---|---|---|---|
| S1300 Ref 1 | 0.21 | 0.21 | 0.90 | 0.0067 | 0.0011 | 0.060 | 0.49 | 1.28 | 0.40 | 0.01 | 0.016 | 0.016 | 0.002 | 0.0012 | 0.0031 |
| S1300 Ref 2 | 0.21 | 0.23 | 0.89 | 0.0078 | 0.0006 | 0.063 | 0.52 | 1.29 | 0.38 | 0.01 | 0.022 | 0.018 | 0.005 | 0.0010 | 0.0035 |
| S1300 Ref 3 | 0.23 | 0.33 | 0.87 | | | 0.080 | 0.67 | 1.10 | 0.56 | | | 0.032 | | 0.0023 | |

Even at extremely low content levels (such as 0.0010%), boron has a transformation-delaying effect. In order to ensure a sufficient quantity of free boron, i.e. boron that is not bonded by nitrogen, throughout the material, it is usually desirable for 0.002-0.003% to be present in the melt analysis; in particular, contents of greater than 0.004% can lead to reductions in toughness and are therefore to be avoided.

As is known, manganese has a transformation-delaying effect. To specifically test the influence of manganese, an alloy with a composition of C=0.12%, Si=0.15%, Ti=0.015%, and 20 ppm boron was varied with different respective manganese contents from 1.60% to 2.20%. As is clear in FIG. 10, it was possible to determine the influence of manganese on the tensile strength. It was furthermore surprisingly observed that in the case of a fully martensitic structure, manganese contents of greater than 2% provide an additional strength contribution in the direct-hardened state (hardened at a cooling rate of 40 K/s in this example).

Chromium contributes to the hardenability. The susceptibility of the steel surface to form pitted scale increases with a higher chromium content. In the range from 0.2 to 0.5%, balanced combinations of hardenability and acceptable outer surfaces were found. Higher chromium contents, however, in particular up to 1% according to the invention, can be advantageous with larger strip thicknesses and the lower cooling rates that these require.

When producing the melt in the steel mill, suitable steps must be taken in order to keep the content of the elements phosphorus and sulfur very low. This is necessary in order to ensure the good toughness properties that are required.

In the embodiment described here, it is not necessary for niobium to be added as a recrystallization-inhibiting element.

In the alloy according to the invention, it is advantageous that the comparatively low content of transformation-delaying elements reduces the forming resistance in comparison to classic hardenable alloys according to the prior art. It is thus possible to reduce the minimum product thickness.

Figure 3:
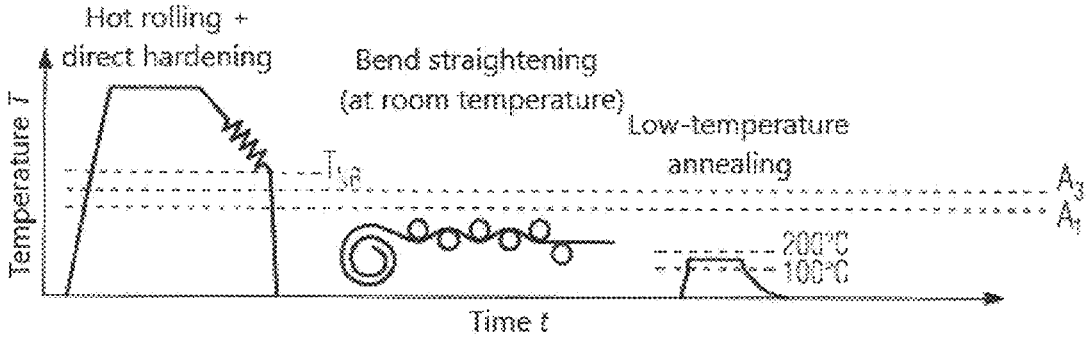
FIG. 3: schematically depicts the processing sequence according to the invention.

The direct hardening process according to the invention (see FIG. 3) immediately follows the hot rolling process, with the martensite structure being produced from the deformed austenite. Because recrystallization-delaying alloying elements are not added, the austenite structure is predominantly recrystallized, fine, and only slightly elongated. This fine-grained, formerly austenite structure provides an additional strength contribution to the martensite. In order to prevent diffusive transformations, a high cooling rate is sought. The cooling rate is at least 10 K/s, particularly preferably 30 to 100 K/s. When the cooling stop temperature (usually room temperature) is reached, at least 95% of the austenite must be transformed into martensite.

Next, the material that has been produced in this way is mechanically straightened and then annealed. Mechanical straightening is required in order to produce a sufficient amount of mobile dislocations, which are fixed with carbon in the subsequent annealing process. For this reason, the volume fraction of the material, which exceeds the yield point in the straightening process and is thus plastically deformed, is not less than 70%. In the case of strip material, the required straightening combines the above-mentioned advantages with the requirement of eliminating the existing coil set during the production of cut sheets.

In methods according to the prior art, high-strength steel products are not direct-hardened after the rolling. In the case of hot-rolling lines, this is due to the fact that these sheets cannot be wound into coils using conventional reeling apparatuses and must therefore be processed or delivered in the form of cut sheets.

According to the invention, however, it has turned out, as explained above, that a deformation is required in order to produce a sufficient degree of mobile dislocation, which can be fixed by means of carbon in the annealing process. According to the invention, the strips are coiled, which has the advantage that the transport limitation due to the dimensions of cut sheets does not apply for the high-strength material according to the invention. The disadvantage of the greater expense of the coiling is accompanied by the advantage that because of the mechanical influence, the high-strength sheets are considerably improved in their mechanical properties. The coiled material that has been wound into coils must be straightened for further processing. But according to the invention, this straightening not only is necessary in order to eliminate the existing coil set, but also results in the fact that the sheet is produced in a homogeneous way with the required mobile dislocations.

Figure 11:
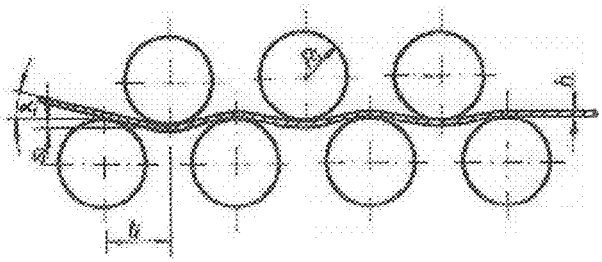
FIG. 11: shows a very schematic depiction of a straightening apparatus.
Figure 12:
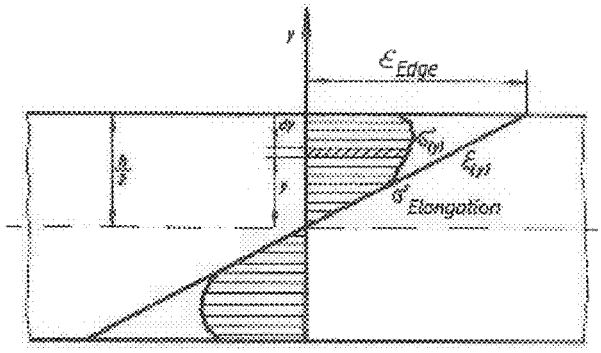
FIG. 12: shows the distribution of stresses during straightening in a bend straightening apparatus.

The straightening is thus necessary on the one hand in order to produce flat cut sheets from the curved strip material, but also on the other in order to produce the dislocation. Usually, the straightening is carried out through repeated bending back and forth in a roller straightening machine. The travel depth of the straightening rollers in this case decreases steadily from the inlet side to the outlet side so that the most intense plasticization is achieved at the inlet of the straightening machine (FIG. 11).

By contrast with elongation straightening apparatuses, in bend straightening apparatuses, there is no elongation of the straightened product on average. There is thus a neutral (=non-elongated, non-plasticized) fiber in the core region of the material. Depending on the geometrical conditions—in particular the roller diameter and spacing, the travel depth, and the sheet thickness—during the straightening, the edge regions of the sheet close to the surface plasticize. The percentage of the plasticized volume close to the surface in the region of the neutral fiber is referred to as the relative plasticized volume.

According to the invention, this relative plasticized volume is at least 70%.

According to the invention, the degree of plasticization, i.e. the percentage of the relative plasticized volume during straightening, can have a significant effect on the mechanical properties of the material.

Figure 13:
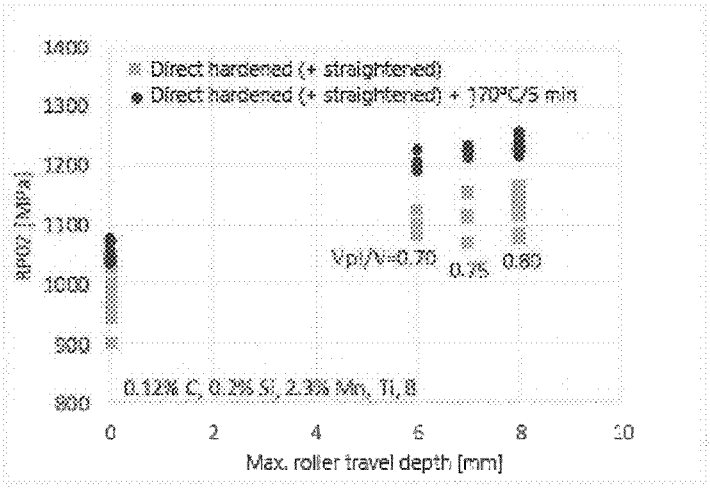
FIG. 13: shows the degree of plasticization as a relative plasticized volume during straightening on the mechanical properties.

In FIG. 13, the test of a material containing C=0.12%, Si=0.2%, Mn=2.3%, Ti=0.014%, and 21 ppm boron, it is clear that depending on the maximum roller travel depth, the mechanical properties increase to a surprisingly high degree compared to a non-straightened material. Particularly if after the direct hardening and straightening, an annealing step is performed (in this example, annealing was performed for 5 minutes at 170° C.), it becomes very clear how powerful an effect the mobile dislocations have, which can be fixed by means of carbon in the subsequent annealing process.

As the tests show, bend straightening with 70 to 80% relative plasticization (labeled Vpl/V in the figure) in comparison to the direct initial state is able to achieve an Rp02 increase on an order of magnitude of 150 MPa. The plasticization therefore has a significant share in the achievable yield strength.

As explained above, ultra-high-strength cut sheets with an Rp02 of at least greater than 1100 MPa have up to this point not been produced in hot strip lines by means of direct hardening, but are instead first rolled into a four-high rolling mill and are sheet metal-hardened in a subsequent process step. The reason for this is that the required coil-winding forces are not available. Because the strength increase that is achievable by means of plasticization according to the invention must be used to reduce the content of alloying elements, in particular carbon, and because of the fact that the necessary plasticization should lie in the vicinity of greater than 70%, it follows that it is no longer necessary to avoid direct hardening and coiling.

Thus according to the invention, the plastic deformation in connection with the annealing step improves the weldability of the material because it enables the optimized alloy composition according to the invention, in particular the reduction in the carbon content.

The annealing process is used to adjust the desired elastic limit or yield strength while at the same time preserving the advantageous tensile strength, toughness, and forming properties that are present after the direct hardening. It has been possible to determine that annealing temperatures below 100° C. do not cause any appreciable effect whereas annealing temperatures above 200° C. lead to noticeable softening phenomena. Accordingly, annealing temperatures of between 100 and 200° C. are desirable according to the invention.

As a consequence of the annealing process, the Rp02/Rm quotient, the so-called elastic limit ratio, increases in a surprisingly conspicuous way relative to the direct-hardened and straightened state and lies in the interval from 0.87 to 0.98 (longitudinal tensile test specimens).

Tests performed on a material according to the invention containing 0.18% carbon, 0.19% silicon, 2.26% manganese, 0.27% chromium, 0.021% titanium, 0.0024% boron, and residual iron and impurities, after annealing with variation of holding time and annealing temperatures, produced the results that correspond to FIGS. 4 to 8.

The corresponding material was rolled, direct-hardened, and according to the invention, coiled in the hot wide-strip line. In this case, it was not necessary to use four-high mills.

The material was then uncoiled and cross-cut; the heat treatment of sheet specimens was performed in air in a laboratory furnace. The time/temperature curve was measured by means of a thermocouple.

Figure 4:
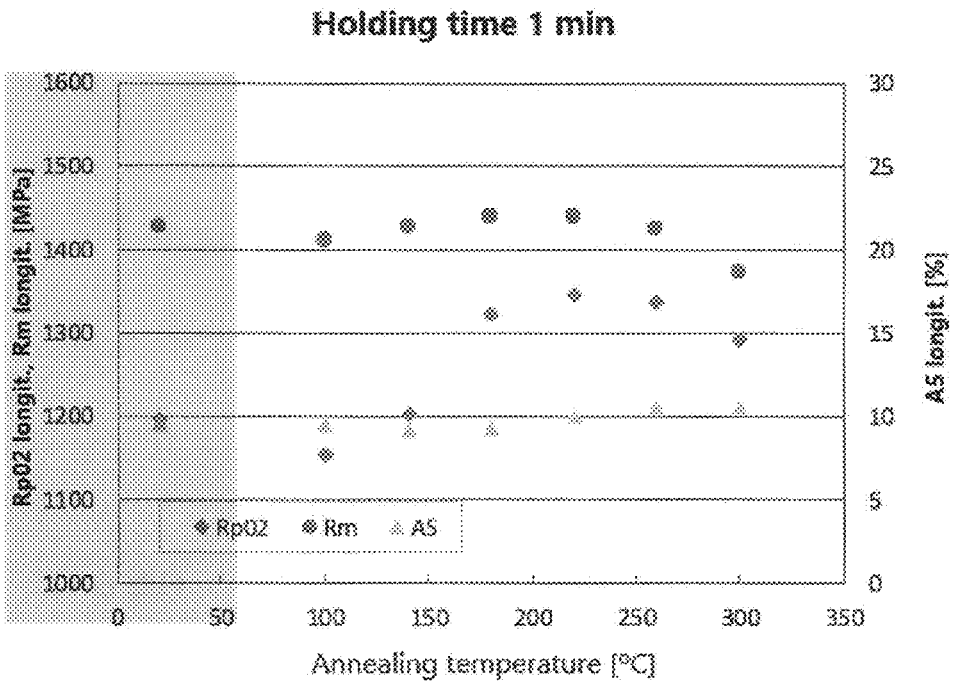
FIG. 4: shows the influence of the annealing temperature and time with a holding time of one minute.
Figure 5:
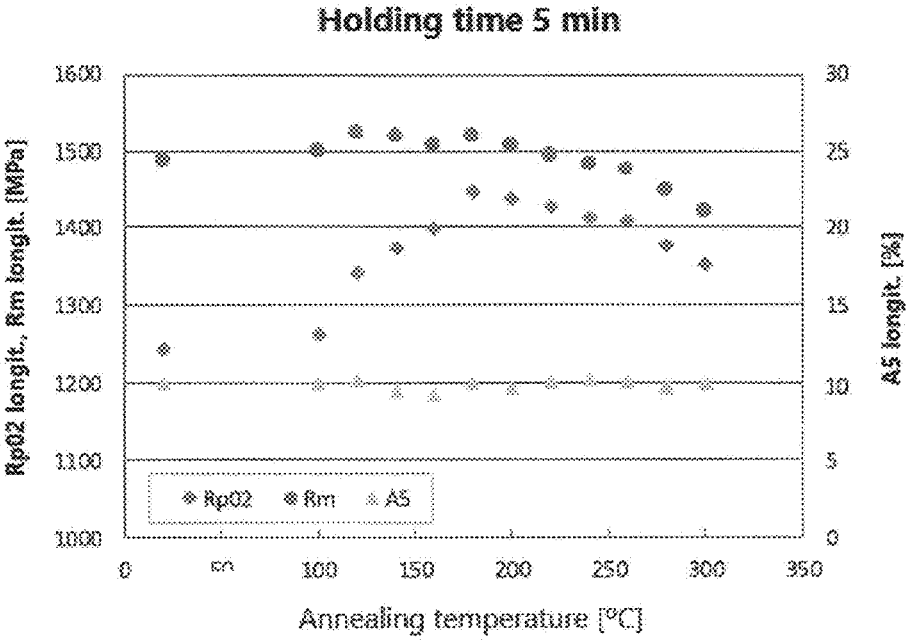
FIG. 5: shows the influence of the annealing temperature and time with a holding time of five minutes.
Figure 6:
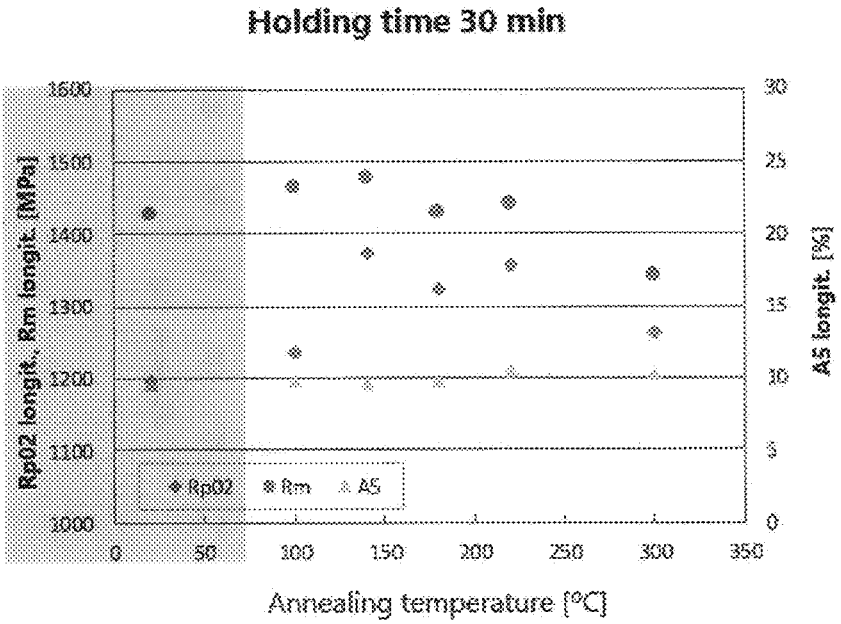
FIG. 6: shows the influence of the annealing temperature and time with a holding time of 30 minutes.
Figure 7:
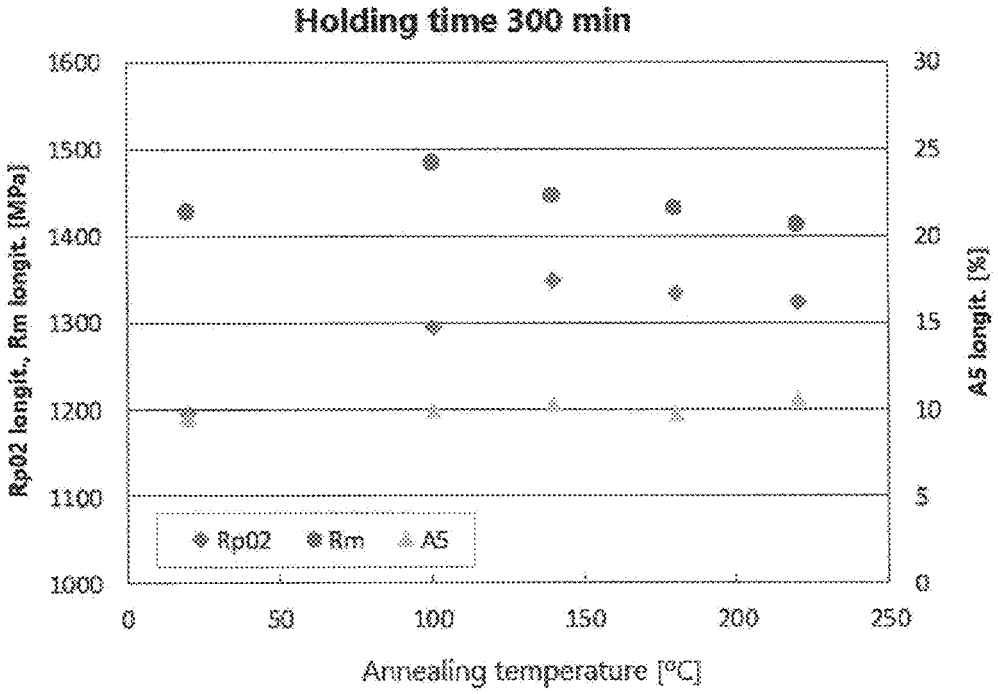
FIG. 7: shows the influence of the annealing temperature and time with a holding time of 300 minutes.

In FIG. 4, it is clear that at annealing temperatures above 150° C. and below 275° C. with a holding time of only one minute, surprisingly high material strengths were achieved.

With a holding time of five minutes in a temperature interval of 110° to 325° C., a considerable hardness was also achieved; the tensile strength Rm can be increased to markedly higher than 1500 MPa, with an elastic limit Rp02 that is likewise greater than 1400 MPa. It should also be noted that according to FIG. 6 and FIG. 7, with holding times of 30 minutes and 300 minutes, no further significant differences are achievable.

With regard to the notched bar impact bending work (testing in accordance with DIN EN ISO 148), it is clear from FIG. 8 that with the indicated holding temperatures and the indicated holding times, a very favorable degree of toughness is achievable; in particular, with one minute and five minutes, the properties can be reliably achieved over a broad temperature range.

According to the invention, the following composition is suitable for a steel composition, all indications being expressed in percent by mass.

C=0.09 to 0.20
Si=0.10 to 0.50
Mn=1.0 to 3.0
P=max. 0.0150
S=max. 0.0050
Al=0.015 to 0.055
Cr=0.2 to 1.0
Ni=max. 0.5
Mo=max. 0.3
V=max. 0.12
Nb=max. 0.035
B=0.0008 to 0.0040
N=max. 0.0100
Ti=0.015 to 0.030
optional: Ca=0.0010 to 0.0040
Residual iron and inevitable smelting-related impurities.

A particularly suitable steel is one with

C=0.16 to 0.20
Si=0.10 to 0.25
Mn=2.0 to 2.4
P=max. 0.0150
S=max. 0.0015
Al=0.015 to 0.055
Cr=0.2 to 0.5
Ni=max. 0.1
Mo=max. 0.05
V=max. 0.12
Nb=max. 0.01
Ti=0.015 to 0.030
B=0.0008 to 0.0040
N=max. 0.0080
optional: Ca=0.0010 to 0.0040
Residual iron and inevitable smelting-related impurities;

here, too, unless otherwise noted, all indications are expressed in percent by mass.

With the low carbon content according to the invention in connection with the direct hardening according to the invention, it is possible to cover a desired strength range of 1150 MPa to 1500 MPa in tensile strength Rm. By avoiding contents >0.2%, it is possible to hinder cold cracking susceptibility in welding.

Silicon is an important element for the deoxidization of steel and leads to strength increases. Silicon contents of >0.1% by mass facilitate the achievement of low sulfur contents, but starting from 0.25% by mass, they increase the scale-forming susceptibility.

Manganese is an important element for delaying transformation. In the composition according to the invention, other transformation-delaying elements are not added to the alloy or are only added to it in small amounts, which is why preferably, a manganese content >2% is added to the alloy in order to achieve a martensitic structure with the direct hardening according to the invention.

With greater product thicknesses and thus lower cooling rates, according to the invention, it can be useful to increase the manganese content to a level of up to 3%. The aluminum present in the mixture according to the invention is an important element for the deoxidization, but unlike in the prior art, is not used in the present invention to release the bonding of nitrogen since titanium is used for this purpose. The content is selected accordingly.

Another important element for delaying transformation is chromium, which is more advantageous than molybdenum and nickel; higher chromium contents increase a scale-forming susceptibility, but improve the tempering resistance.

According to the invention, vanadium is not absolutely required, but can be added in order to increase the tempering resistance in regions of local heat exposure; contents >0.12% diminish the toughness and should be avoided.

The indicated niobium content is likewise not absolutely required, but can be used for additional grain refining. The direct hardening according to the invention, however, is not reliable with contents >0.035% by mass since this reduces the hardenability.

The titanium that is present in the steel according to the invention bonds with the nitrogen to form titanium nitride and thus hinders the formation of boron nitride, which would sharply reduce the hardenability.

The boron that is present is an important element for delaying transformation.

If need be, calcium can be added in order to influence sulfide formation, which should effectively prevent the occurrence of significantly elongated manganese sulfides. In this case, the calcium content should not be less than 0.0010 since otherwise, a sufficient influence on sulfide formation is not assured. Furthermore, the calcium content should not exceed 0.0040 in order to avoid a reduction in toughness.

With the invention, it is advantageous that through the special selection of the steel composition on the one hand and through the direct hardening with a subsequent mechanical straightening process and a corresponding annealing treatment in the range between 100 and 200° C. on the other hand, high-strength structural steels with good weldability can be achieved in a very reliable way.

The invention claimed is:

1. A method for producing an ultra-high-strength hot-rolled structural steel or construction steel, comprising the steps of:

providing a steel alloy including the following elements in the following amounts, expressed as percent by mass:

C=0.09 to 0.20,
Si=0.10 to 0.50,
P=max. 0.0150,
S=max. 0.0050,
Al=0.015 to 0.055,
Ni=max. 0.5,
Mo=max. 0.3,
V=max. 0.12,
Nb=max. 0.035,
N=max. 0.0100,
Ti=0.015 to 0.030,
B=0.008 to 0.040,
Cr=0.2 to 1.0,
Mn=1.0 to 3.0, and
optional: Ca=0.0010 to 0.0040, and
remainder iron and inevitable impurities;

casting the steel alloy to form a cast steel alloy;

heating the cast steel alloy;

hot rolling the cast steel alloy to form a hot rolled steel alloy strip;

hardening the hot rolled steel alloy strip immediately after hot rolling by quenching at a cooling rate of at least 10 K/sec.;

mechanically straightening the hot rolled steel alloy strip to produce mobile dislocations in the hot rolled steel alloy strip; and annealing the mechanically straightened hot rolled steel alloy strip at a temperature of about 100° C. to about 200° C.;

wherein the B, Mn and Cr delay diffusive transformation of the steel alloy from an austenite structure to achieve a martensite structure during the hardening after the hot rolling of the steel alloy strip;

the martensite structure forms from the austenite structure during the hardening of the hot rolled steel alloy strip; and the Cr improves the hardenability of the steel alloy during the step of hardening the hot rolled steel alloy strip.

2. The method according to claim 1, wherein the Mn is included in an amount of 2% to 3% by mass.

3. The method according to claim 1, wherein the annealing is performed in a temperature range of 120 to 200° C. for 1 to 30 minutes.

4. The method of claim 3, wherein the annealing is performed in a temperature range of 130 to 190° C. for 2 to 14 minutes.

5. The method according to claim 3, wherein the annealing is performed in a temperature range of 135 to 170° C. for 2 to 14 minutes.

6. The method according to claim 1, wherein the steel alloy includes the following elements in the following amounts, expressed in percent by mass:

C=0.16 to 0.20,
Si=0.10 to 0.25,
Mn=2.0 to 2.4,
P=max. 0.0150,
S=max. 0.0015,
Al=0.015 to 0.055,
Cr=0.2 to 0.5,
Ni=max. 0.1,
Mo=max. 0.05,
V=max. 0.12,
Nb=max. 0.01,
Ti=0.015 to 0.030,
B=0.0008 to 0.0040,
N=max. 0.0080,
optional: Ca=0.0010 to 0.0040, and
residual iron and inevitable smelting-related impurities.

7. The method of claim 6, wherein the mechanical straightening is performed such that a volume fraction of the hot rolled steel alloy strip that exceeds a yield point in the straightening process is not less than 70%.

8. The method of claim 7, wherein the mechanical straightening comprises the step of repeatedly bending the hot rolled steel alloy sheet back and forth in a roller straightening machine.

9. The method according to claim 1, further comprising the step of bonding the Ti to the N to avoid the formation of boron nitrides.

10. The method according to claim 1, further comprising the step of adjusting the amounts of the Mn, Cr and B as needed to avoid the diffusive transformation of the austenite structure to the martensite structure during the casting of the steel alloy.

11. The method according to claim 1, wherein the step of hardening the hot rolled steel strip comprises cooling at a high cooling rate sufficient to transform at least 95% of the re-austenitized hot rolled steel alloy strip into a martensite structure.

12. The method according to claim 11, wherein the cooling rate is between 30 K/sec and 100 K/sec.

13. The method according to claim 1, wherein the step of mechanically straightening the hot rolled steel alloy strip is performed under conditions that produce a sufficient amount of mobile dislocations to yield a relative plasticized volume of not less than 70% by volume.

14. The method according to claim 1, wherein the annealing is performed under conditions that yield an Rp02/Rm quotient, representing an elastic limit ratio, of between 0.87 and 0.98 measured using longitudinal tensile test specimens.

15. A method for producing a hot-rolled steel, comprising the steps of:

providing a steel alloy including the following elements in the following amounts, expressed as percent by mass:

C=0.09 to 0.20,
Si=0.10 to 0.50,
P=max. 0.0150,
S=max. 0.0050,
Al=0.015 to 0.055,
Ni=max. 0.5,
Mo=max. 0.3,
V=max. 0.12,
Nb=max. 0.035,
N=max. 0.0100,
Ti=0.015 to 0.030,
B=0.008 to 0.040,
Cr=0.2 to 1.0,
Mn=1.0 to 3.0, and
optional: Ca=0.0010 to 0.0040, and
remainder iron and inevitable impurities;

casting the steel alloy to form a cast steel alloy;

heating the cast steel alloy;

hot rolling the cast steel alloy to form a hot rolled steel alloy strip;

hardening the hot rolled steel alloy strip immediately after hot rolling by quenching at a cooling rate of at least 10 K/sec.;

mechanically straightening the hot rolled steel alloy strip without elongating it to produce mobile dislocations in the hot rolled steel alloy strip, such that a volume fraction of the hot rolled steel alloy strip that exceeds a yield point in the straightening process is not less than 70%; and annealing the mechanically straightened hot rolled steel alloy strip at a temperature of about 100° C. to about 200° C.;

wherein the B, Mn and Cr delay diffusive transformation of the steel alloy from an austenite structure to achieve a martensite structure during the hardening after the hot rolling of the steel alloy strip;

the martensite structure forms from the austenite structure during the hardening of the hot rolled steel alloy strip; and the Cr improves the hardenability of the steel alloy during the step of hardening the hot rolled steel alloy strip.

16. The method of claim 15, wherein the elements are included in the following amounts:

C=0.16 to 0.20,
Si=0.10 to 0.25,
Mn=2.0 to 2.4,
P=max. 0.0150,
S=max. 0.0015,
Al=0.015 to 0.055,
Cr=0.2 to 0.5,
Ni=max. 0.1,
Mo=max. 0.05,
V=max. 0.12,
Nb=max. 0.01,
Ti=0.015 to 0.030,
B=0.0008 to 0.0040,
N=max. 0.0080,
optional: Ca=0.0010 to 0.0040, and
residual iron and inevitable smelting-related impurities.

17. The method of claim 15, wherein the hot rolled steel sheet has a structure that includes more than 95%, martensite accompanied by residual bainite and/or ferrite.

18. The method of claim 17, wherein the structure includes more than 99% martensite.

19. The method of claim 15, wherein the hot rolled steel sheet has an Rp02/Rm quotient representing an elastic limit ratio, of between 0.87 and 0.98.

20. A method for producing a hot-rolled steel, comprising the steps of:

providing a steel alloy including the following elements in the following amounts, expressed as percent by mass:

C=0.09 to 0.20,
Si=0.10 to 0.50,
P=max. 0.0150,
S=max. 0.0050,
Al=0.015 to 0.055,
Ni=max. 0.5,
Mo=max. 0.3,
V=max. 0.12,
Nb=max. 0.035,
N=max. 0.0100,
Ti=0.015 to 0.030,
B=0.008 to 0.040,
Cr=0.2 to 1.0,
Mn=1.0 to 3.0, and
optional: Ca=0.0010 to 0.0040, and
remainder iron and inevitable impurities;

casting the steel alloy to form a cast steel alloy;

heating the cast steel alloy;

hot rolling the cast steel alloy to form a hot rolled steel alloy strip;

hardening the hot rolled steel alloy strip immediately after hot rolling by quenching at a cooling rate of at least 10 K/sec.;

mechanically straightening the hot rolled steel alloy strip, by repeatedly bending the hot rolled steel alloy sheet back and forth in a roller straightening machine, to produce mobile dislocations in the hot rolled steel alloy strip; and annealing the mechanically straightened hot rolled steel alloy strip at a temperature of about 100° C. to about 200° C.;

wherein the B, Mn and Cr delay diffusive transformation of the steel alloy from an austenite structure to achieve a martensite structure during the hardening after the hot rolling of the steel alloy strip;

the martensite structure forms from the austenite structure during the hardening of the hot rolled steel alloy strip; and the Cr improves the hardenability of the steel alloy during the step of hardening the hot rolled steel alloy strip.

21. The method of claim 20, wherein the elements are included in the following amounts:

C=0.16 to 0.20,
Si=0.10 to 0.25,
Mn=2.0 to 2.4,
P=max. 0.0150,
S=max. 0.0015,
Al=0.015 to 0.055,
Cr=0.2 to 0.5,
Ni=max. 0.1,
Mo=max. 0.05,
V=max. 0.12,
Nb=max. 0.01,
Ti=0.015 to 0.030,
B=0.0008 to 0.0040,
N=max. 0.0080,
optional: Ca=0.0010 to 0.0040, and
residual iron and inevitable smelting-related impurities.

* * * * *